US005659959A

United States Patent [19]

Parlowski

[11] Patent Number: 5,659,959

[45] Date of Patent: Aug. 26, 1997

[54] SHEARS WITH ROTATABLE HANDLE

[75] Inventor: Jurgen M. Parlowski, Brooklyn, N.Y.

[73] Assignee: General Housewares Corp., Terre Haute, Ind.

[21] Appl. No.: 595,398

[22] Filed: Feb. 23, 1996

[51] Int. Cl.[6] ..... B25G 3/38

[52] U.S. Cl. ..... 30/232; 16/110 R; 30/254; 30/341

[58] Field of Search ..... 30/260, 256, 254, 30/341, 340, 232, 244; 16/114 R, 110 R; 81/427.5, 177.1

[56] References Cited

U.S. PATENT DOCUMENTS

| | | | |
|---|---|---|---|
| 187,713 | 2/1877 | Kelly . | |
| 200,754 | 2/1878 | Pichon . | |
| 242,000 | 5/1881 | Klaucke . | |
| 300,153 | 6/1884 | Starks . | |
| 404,667 | 6/1889 | Woodhouse et al. | 30/341 |
| 753,919 | 3/1904 | Rowe . | |
| 785,934 | 3/1905 | Border . | |
| 927,058 | 6/1909 | Krouse . | |
| 1,284,351 | 11/1918 | Jagielo . | |
| 1,479,908 | 3/1924 | Goshia . | |
| 1,503,536 | 8/1924 | Klauke . | |
| 1,640,635 | 8/1927 | Atkins . | |
| 1,757,173 | 5/1930 | Dingman et al. . | |
| 2,640,264 | 6/1953 | Sullivan et al. . | |
| 2,744,324 | 5/1956 | Chuba . | |
| 3,325,897 | 6/1967 | Luebkeman . | |
| 3,906,630 | 9/1975 | Megna . | |
| 3,978,584 | 9/1976 | Mayer . | |
| 4,254,551 | 3/1981 | Megna et al. . | |
| 4,457,038 | 7/1984 | Hammond | 16/114 R |
| 4,520,556 | 6/1985 | Davis | 16/114 R |
| 4,598,477 | 7/1986 | Quick | 30/260 |
| 4,642,895 | 2/1987 | Gauvry . | |
| 4,742,617 | 5/1988 | Gauvry . | |
| 5,060,381 | 10/1991 | Taberlet | 30/232 |
| 5,109,608 | 5/1992 | Pracht | 30/341 |
| 5,168,629 | 12/1992 | Willard . | |
| 5,231,727 | 8/1993 | Armbruster | 16/110 R |

FOREIGN PATENT DOCUMENTS

| | | | |
|---|---|---|---|
| 2648384 | 12/1990 | France | 30/232 |
| 3030552 | 3/1982 | Germany | 30/244 |
| 996685 | 6/1965 | United Kingdom | 30/341 |

OTHER PUBLICATIONS

Two pages of Felco brochure and photographs of Felco 7 pruning shears. Date uknown.

*Primary Examiner*—Kenneth E. Peterson
*Attorney, Agent, or Firm*—Emrich & Dithmar

[57] ABSTRACT

A two-lever implement, such as shears, is provided. The implement includes a first lever having a first handle fixed thereon and a second lever pivotally connected to the first lever. The second lever has a second handle which includes a fixed core having an axis and a rotatable outer member disposed about and coaxial with the fixed core and rotatable to and from an at-rest position about the axis. The implement also includes resilient structure carried by the second lever for biasing the outer member back to the at-rest position after the outer member has been moved from the at-rest position.

16 Claims, 3 Drawing Sheets

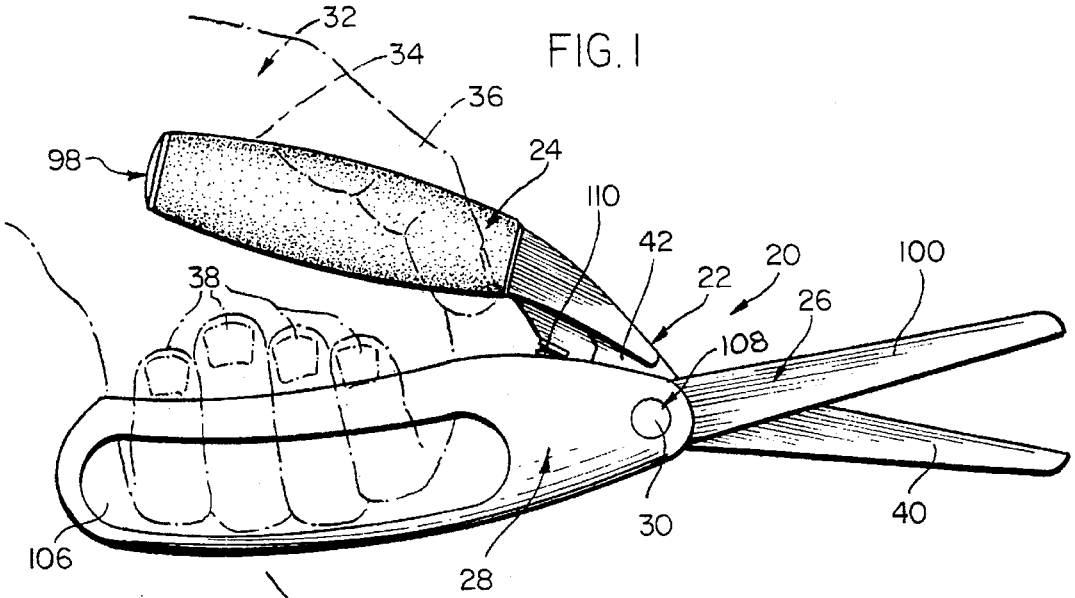
FIG. 1
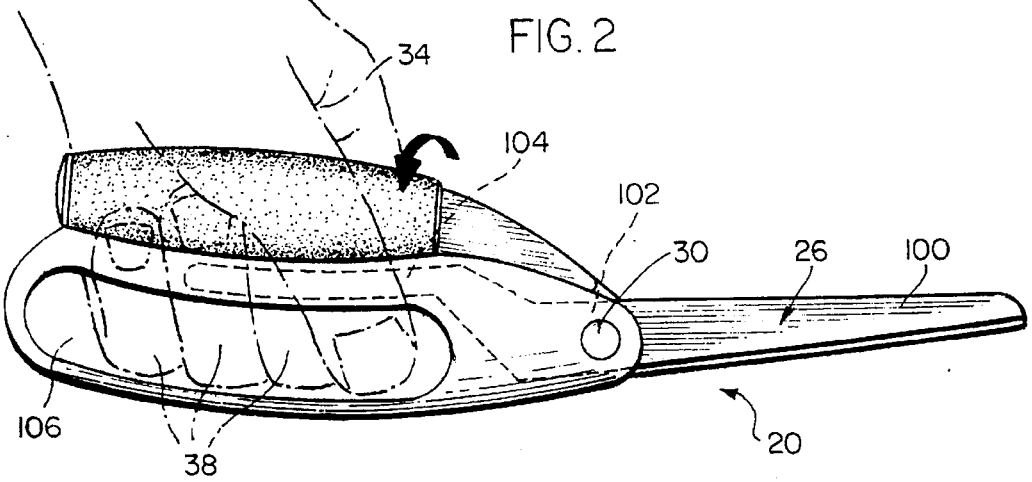
FIG. 2
FIG. 3
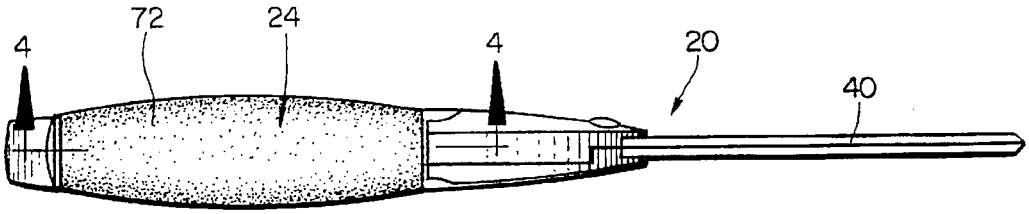

FIG. 4
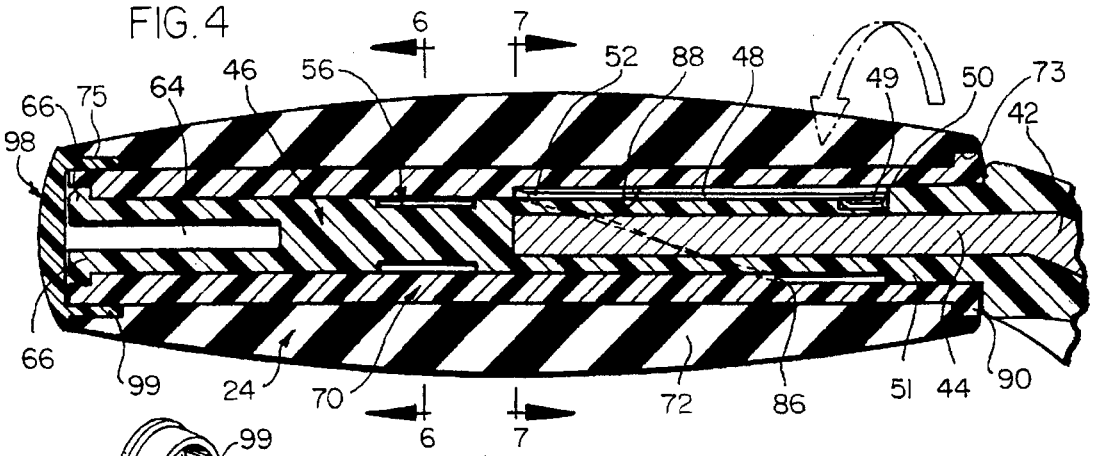
FIG. 5
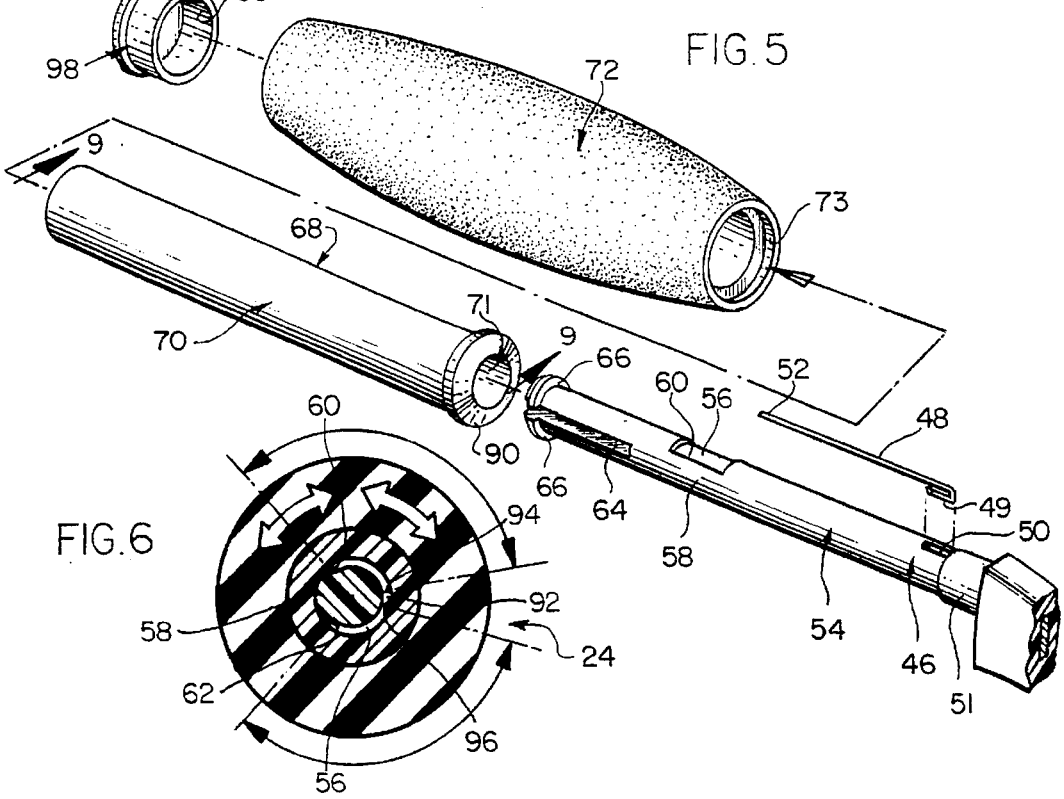
FIG. 6
FIG. 7
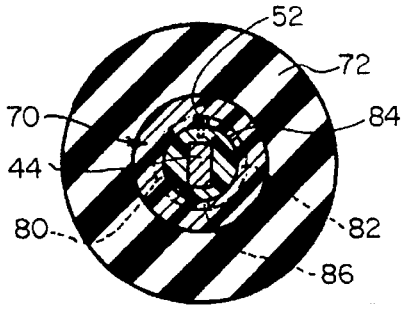
FIG. 8
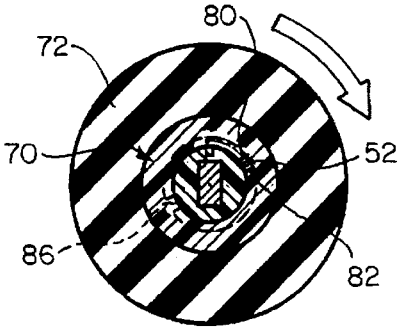

SHEARS WITH ROTATABLE HANDLE

BACKGROUND OF THE INVENTION

1. Field of the Invention

This invention relates to two-lever implements, and more particularly, to shears pivotally interconnected and having an ergonomic handle configuration.

2. Description of the Prior Art

In the past, conventional scissors have been constructed with a small loop on an upper lever to accommodate a user's thumb and a large loop connected to the bottom lever to accommodate several or all of a user's fingers. The user's hand when using these conventional scissors resembles a lobster claw. This lobster-like hand positioning does not allow all of the muscles in the hand to be properly utilized and often does not allow a user to easily provide enough force to cut through thick, heavy or strong materials. These scissors mainly require a user's fingers to pull up the bottom lever toward the upper lever to cut a material. Since a user's fingers are weak compared to the remainder of the hand, a user is quickly fatigued. Also, if a user must use a conventional scissors over long periods of time, the user can experience discomfort and develop a repetitive motion disorder, such as carpel tunnel syndrome.

In an effort to increase the comfort to a user and allow the user to more easily cut an object, shears have been developed with a fixed upper lever engageable with a user's thumb and a freely rotatable bottom lever so that as the two levers are brought together to cut an object, the bottom lever rotates and the fingers engaged therewith naturally roll over so that a not quite-closed fist is formed with the thumb that is engaged with the fixed upper lever.

Although these shears are more comfortable to use, extended and prolonged use can still cause a user to develop a repetitive motion disorder because the shears still require a user's fingers to pull the bottom lever upward to the top lever. Additionally, the handle of these shears with the freely rotatable handle are not symmetrical and are designed to be used with either a right hand or a left hand, but not both.

The freely rotatable handle of these shears make these shears adjustable and does not easily allow precise cuts through light materials because the free finger rotation on the bottom handle often causes the shears to cut off-line. Additionally, the freely rotating handle makes it difficult for a user to maintain a controlling grip on the shears, which will cause the shears to fall out of a user's hand and cause personal injury or damage.

SUMMARY OF THE INVENTION

It is a general object of the invention to provide an improved shears which avoids the disadvantages of prior shears while affording additional structural and operating advantages.

An important feature of the invention is the provision of shears of the crossed pivoting lever type, which have an ergonomically designed rotatable handle configured to minimize fatigue in use.

In connection with the foregoing feature, a further feature of the invention is the provision of shears of the type set forth, which facilitate rolling movement of the user's thumb and palm from an initial grasping position to a final grasping position to allow efficient user cutting, while preventing user fatigue.

A further feature of the invention is the provision of shears of the type set forth which can be used with either the left or right hand.

A still further feature of the invention is the provision of shears of the type set forth, which has a rotatable handle normally biased to an at-rest position which inhibits unwanted rotation and facilitates precise cutting capability and user control.

These and other features of the invention are attained by providing a two-lever implement, including a first lever having a first handle fixed thereon and a second lever pivotally connected to the first lever. The second lever has a second handle which includes a fixed core having an axis and a rotatable outer member disposed about and coaxial with the fixed core and rotatable about the axis to and from an at-rest position. The implement also includes resilient structure carried by the second lever for biasing the outer member back to the at-rest position after the outer member has been moved from the at-rest position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevational view of the rotatable handle shears of the present invention in their open condition as grasped by a user's hand, shown in phantom;

FIG. 2 is a view similar to FIG. 1, with the shears in their closed condition;

FIG. 3 is a top plan view of the shears of FIG. 1;

FIG. 4 is an enlarged, fragmentary, sectional view taken generally along the line 4—4 of FIG. 3;

FIG. 5 is an enlarged, exploded, perspective view of the upper, rotatable handle of the shears;

FIG. 6 is a sectional view taken generally along line 6—6 in FIG. 4;

FIG. 7 is a sectional view taken generally along line 7—7 in FIG. 4;

FIG. 8 is a view similar to FIG. 7 after the rotatable outer structure of the upper handle has been rotated clockwise from its at-rest position;

DETAILED DESCRIPTION OF THE PREFERRED EMBODIMENT

Figure 9:
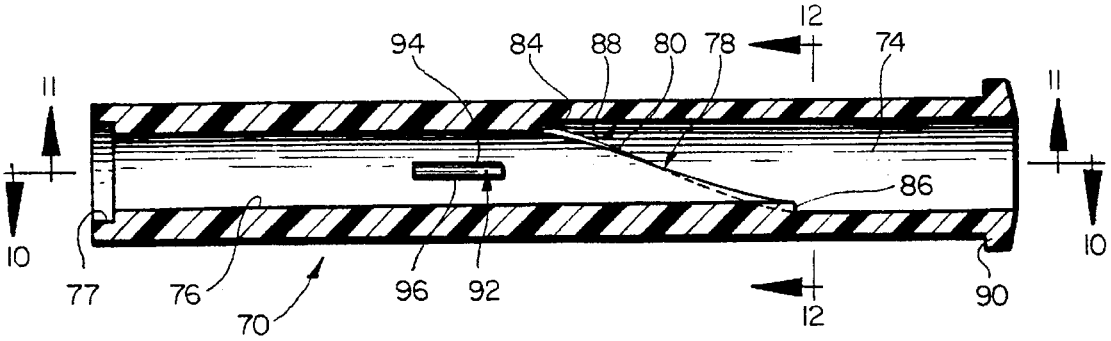
FIG. 9 is a further enlarged, sectional view taken generally along line 9—9 of FIG. 5.

Referring to FIGS. 1–3 of the drawings, there is illustrated a shears 20, constructed in accordance with and embodying the features of the present invention. The shears 20 is of the crossed, pivoting lever type, including an upper lever 22 having an upper handle 24 and a lower lever 26 having a lower handle 28, the levers 22 and 26 being pivotally interconnected at a pivot joint 30. The shears 20 are arranged to be manipulated, in use, by a single hand 32 of a user. More specifically, the user's palm 34 and thumb 36 are engageable with the upper handle 24, while the user's fingers 38 are engageable with the lower handle 28, in a manner which will be more fully described hereinafter.

The upper lever 22 includes an elongated blade end 40, an inclined portion 42, inclined at a predetermined angle with respect to the blade end 40, and a handle end 44 integral with the inclined portion 42 and extending rearwardly therefrom. Preferably, the upper lever 22 is of unitary, one-piece construction, being formed of a suitable metal, such as stainless steel.

As seen in FIGS. 4–5, the upper handle 24 includes an elongated, substantially cylindrical fixed core 46 having a longitudinal axis and molded around the handle end 44, and being formed of a suitable hard plastic material. An elongated spring 48 has a fixed U-shaped end 49 and a free distal end 52. The fixed end 49 is press-fitted, or otherwise assembled into a slot 50 disposed in the fixed core above the top of the handle end 44 adjacent to an enlarged diameter end 51 of the core 46. The fixed core 46 has a substantially cylindrical exterior surface 54 of a diameter slightly less than that of end 51, and the spring 48 extends axially along the exterior surface 54. Formed in the exterior surface 54 just beyond the distal end 52 of the spring 48 is a shallow recess 56 extending circumferentially about ¾ of the way around the fixed core 46 and defining at its opposite ends radial stop surfaces 60 and 62 (FIG. 6). The distal end of the fixed core 46 is bifurcated by an axial slot 64 with each bifurcated half having a radially outwardly extending semi-annular shoulder 66.

The upper handle 24 also includes a rotatable outer structure 68 disposed about and coaxial with the fixed core 46. The rotatable outer structure 68 includes a substantially cylindrical rotatable core member 70 having an axial bore 71 therethrough and an exterior handle member 72 fixedly connected to and disposed about the substantially cylindrical rotatable core member 70.

Figure 10:
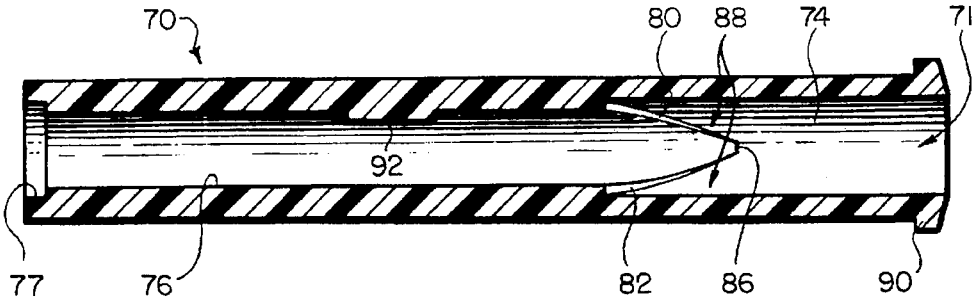
FIG. 10 is a sectional view taken generally along line 10—10 of FIG. 9.
Figure 11:
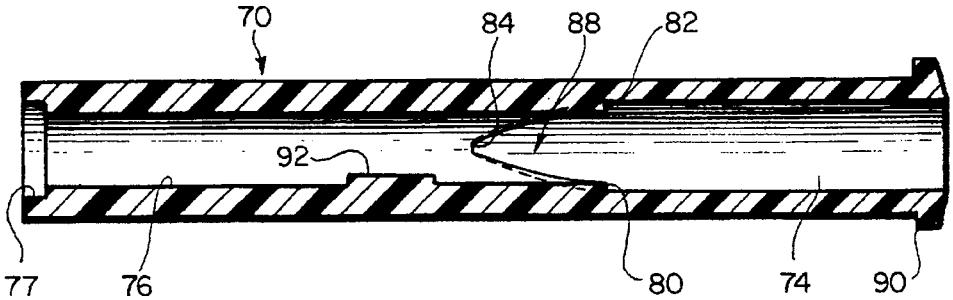
FIG. 11 is a sectional view taken generally along line 11—11 of FIG. 9.
Figure 12:
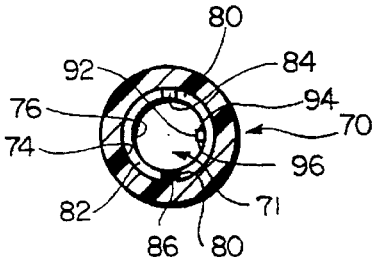
FIG. 12 is a sectional view taken generally along line 12—12 of FIG. 9.

As seen in FIGS. 7–12, the rotatable core member 70 has at one end a first substantially cylindrical interior surface portion 74 dimensioned to slidably receive the enlarged diameter end 51 of the fixed core 46, and has at the other end a second substantially cylindrical interior surface portion 76 dimensioned to slidably receive the exterior surface 54 of the fixed core 46 and having a counterbore 77. Formed between the interior surface portions 74 and 76 is a radial shoulder structure 78 including two generally helical side walls 80 and 82 and two short end walls 84 and 86. The end walls 84 and 86 are axially spaced apart on the core member 70 at diametrically opposite sides thereof and are joined by the sidewalls 80 and 82 to define a recess 88. More specifically, the side walls 80 and 82 respectively define half turns of spirals extending in opposite directions, so that the recess increases in transverse cross-sectional area from the first end wall 84 to the second end wall 86. As discussed further below, the free end 52 of the spring 48 is disposed in the recess 88.

The rotatable core member 70 also includes a radially outwardly extending annular flange 90 at the end thereof opposite the counterbore 77. A stop member 92 projects radially inwardly from the second substantially interior surface portion 76 thereby forming stop shoulder surfaces 94, 96.

The rotatable core member 70 is rotatable connected to the fixed core 46 by squeezing the two shoulder portions 66 together to allow them to be inserted into the axial bore 71, and inserting the fixed core 46 into the axial bore 71 until the shoulder portions 66 are disposed in the counterbore 77, thereby locking the rotatable core member 70 to the fixed core 46.

The exterior handle member 72 is disposed about and fixedly connected to the rotatable core member 70 by conventional means. The handle member 72 has a counterbore 73 at one end to receive the flange 90 and has a counterbore 75 at the other end thereof (FIG. 4). The exterior handle member 72 engages a user's hand and is preferably made of a soft material having a high coefficient of friction, such as a soft rubber. This type of material, as discussed below, provides comfort to the user and causes the rotatable outer structure 68 to properly rotate when a user is employing the shears 20.

The upper handle 24 also includes at its rear end an end cap 98 having a cylindrical wall 99 disposed in the counterbore 75 of the exterior handle member 72 and around the rotatable core member 70 and a portion of the interior surface of the exterior handle member 72. If desired, the exterior handle member 72 may be closed at its rear end and the end cap 98 may be eliminated.

As seen best in FIG. 2, the lower lever 26 is also of unitary, one-piece construction of the same material as the upper lever 22, and includes an elongated blade end 100, a Joint region 102 and a handle end 104. The lower handle 28 is preferably of molded plastic construction and is molded around the handle end 104 and joint region 102 of the lower lever 26. The lower handle 28 also has a generally oval-shaped aperture 106 therethrough for receiving and engagement by the user's fingers 38. As discussed above, the upper and lower levers 22, 26 are pivotally interconnected at the pivot joint 30 which can be any conventional pivot such as a bolt 108 disposed through bores (not shown) on the upper and lower levers 22, 26.

The shears 20 have an open condition (FIG. 1) wherein the upper handle 24 and lower handle 28 are separated, and a closed condition wherein the handles 24, 28 are brought together and the blade ends 40, 100 lie side by side. The shears 20 are biased in a conventional manner to the open position (FIG. 1) by a spring 110 disposed between the upper and lower levers 22, 26.

Referring in particular to FIGS. 1–2, the operation of the shears 20 will be described in detail. The user grasps the lower handle 20 with the curled fingers 38 of the hand 32 being received through the oval-shaped aperture 106. When the Shears 20 are in their open condition (FIG. 1), a user will initially grasp the upper handle 30 by hooking the thumb 36 over the top of the upper handle 24. It will be appreciated that the exterior handle member 72, due to its being constructed of material with a high coefficient of friction, prevents the thumb 36 from sliding forwardly off the upper handle 24. It will further be appreciated that, during this initial grasping operation, the fingers 38 are unencumbered and can be freely uncurled and curled to obtain a good grip with the lower handle 28.

As the user exerts enough of a downward force with his thumb 36 on the upper handle 24, the user's thumb 34 which is frictionally engaged with the exterior handle member 72, causes the rotatable outer structure 68 to rotate (in the case of a left-handed user), in the directions of the arrows in FIGS. 2, 4, and 8.

As the handles 24 and 28 begin to move closer together, the user's thumb 36 rolls downwardly (simultaneously with the rotation of the rotatable outer structure 68) alongside the upper handle 24. During the continued closing of the handles, the hand 32 continues to roll over the top of the upper handle 24, until the user's palm 34 is disposed on top of the upper handle 24, with the thumb 36 extending completely down along the inner sides of the upper and lower handles 24 and 28, as can be seen in FIG. 2, for exerting maximum closing force.

The rotation of the upper handle 24 aids in preventing user fatigue and causing a repetitive motion disorder because it allows the stronger combined muscles of thumb 36 and palm 34 to be better utilized to push the upper handle 24 downwardly to the lower handle 28 to close and operate the shears 20. This is much more desirable than using the weak finger muscles of a user's hand to pull upwardly toward the upper handle, as in the case of conventional shears. In operating the shears 20, the user's fingers 38 remain more stationary than the user's thumb 36 and palm 34 which also aids in preventing a repetitive motion disorder.

It is a significant aspect of the invention that the rotatable outer structure 68 is biased by the spring 48 to an at-rest position, as seen in FIGS. 4 and 7. When the rotatable outer structure 68 is begun to be rotated out of the at-rest position by a user's hand 32, the shoulder structure 78 of the rotatable outer structure 68 contacts and deflects the free end 52 of the spring 48 biasing the rotatable outer structure 68 back to its at-rest position. This is especially useful when the shears are used to make precise cuts of light-weight material in preventing rotation of the rotatable outer structure 68 which can cause the blade ends 40 and shears 20 to .move with the rotation making precise cutting difficult.

The contact of the spring 48 with the shoulder structure 78 provides a biasing force which must be overcome before the rotatable outer structure 68 can begin to rotate. Since a user exerts little rotational force to the rotatable outer structure 68 when making light cuts, rotation of the rotatable outer structure 68 is substantially or totally prevented during this operation thereby making precision cuts of light materials easier.

As discussed above, the spring 48 is disposed in the recess 88. The recess 88 increases in circumferential width axially from the first end wall 84 t0 the Second end wall 86 and, therefore, from the free end 52 of the spring 48 toward the fixed end 50 of the spring 48. This axial increase in cross-sectional area (or increased circumferential recess spacing between the sidewalls 80, 82) provides room so that when the free end 52 of the spring 48 deflects when contact is made with one of the sidewalls 80, 82 of the shoulder structure 78, the portions of the spring 48 closer to the fixed end 50 do not make contact with the respective sidewalls 80, 82 which would prevent rotation of the rotatable outer, structure 68.

As seen best in FIG. 6, the upper handle 24 includes means to limit the rotation of the rotatable outer structure 68 to prevent damage to the spring 48 (which could otherwise coil around the fixed core 46). The stop member 92 is disposed in the recess 56. Therefore, when the rotatable outer structure 68 is rotated counter-clockwise, as seen in FIG. 6, the stop surface 94 of the stop member 92 contacts the stop surface 60 at one end of the recess 58 to prevent further counter-clockwise rotation. Likewise, when the rotatable outer surface 68 is rotated clockwise, as viewed in FIG. 6, the stop surface 96 of the stop member 92 contacts the stop surface 62 at the other end of the recess 58 to prevent further clockwise rotation. The stop surfaces 60, 62 are spaced about 230 degrees apart, thereby providing the rotatable outer surface 68 with a range of rotation of approximately or slightly less than 230 degrees.

Though the rotatable upper handle 24 is illustrated on a pair of shears 20, such a rotatable handle is useful on the upper lever of any interconnected two-lever open-biased implement that requires the two handles of the implement to be squeezed. Examples of such implements include, without limitation, hole punchers, hand gripping exercisers, battery and other clamps and many other hand tools.

Also, though the U-shaped end 49 of the spring is preferably disposed in the slot 50 above the top of handle end 44, if necessary for molding reasons or to make the slot 50 deeper to better retain the spring 48, the slot 50 and U-shaped end 49 of the spring 48 can be moved ninety degrees around the core 46 to the side of the handle end 44. In that case, the recess 56 would be correspondingly moved ninety degrees.

While particular embodiments of the present invention have been shown and described, it Will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A two lever implement comprising: a first lever having a fixed first handle; a second lever pivotally connected to the first lever and having a second handle including a fixed core having an axis and a rotatable outer member having a continuous interior surface, the outer member disposed about and coaxial with the fixed core and rotatable about the axis to and from an at-rest position; and a resilient structure completely disposed within the continuous interior surface and carried by the second lever for rotationally biasing the outer member back to the at-rest position after the outer member has been rotated from the at-rest position, whereby when the outer member is in the at-rest position, the resilient structure exerts substantially no biasing force on the outer member.

2. The implement of claim 1, wherein the interior surface of the rotatable outer member has a substantially cylindrical interior surface portion having a radial shoulder structure and the fixed core has a substantially cylindrical exterior surface portion facing the substantially cylindrical interior surface portion of the rotatable outer member, and the resilient structure includes an elongated spring having a fixed end connected to the fixed core and a free end, whereby when the rotatable outer member is rotated out of the at-rest position the radial shoulder structure contacts and deflects the free end of the spring rotationally biasing the rotatable outer member back to the at-rest position.

3. The implement of claim 2, wherein the fixed core has a first stop surface formed on the substantially cylindrical exterior surface portion and the outer member has a second stop surface formed on the substantially cylindrical interior surface portion, whereby when the rotatable outer member is rotated a predetermined distance the second stop surface contacts the first stop surface to prevent further rotation of the rotatable outer member.

4. The implement of claim 3, wherein the rotatable outer member has a range of rotation of approximately 230 degrees.

5. The implement of claim 2, wherein the radial shoulder structure includes a first sidewall and a second sidewall, first and second end walls axially disposed apart, each end wall connecting the first and second sidewalls, each sidewall defining a substantially part-helical path along said interior surface portion with the sidewalls respectively extending laterally in opposite directions from said end walls.

6. The implement of claim 5, wherein the first and second sidewalls and the first and second end walls define a recess, the free end of the spring is disposed in the recess.

7. Shears comprising: a first lever having a first blade and a fixed first handle; a second lever pivotally connected to the first lever and having a second blade and a second handle including a fixed core having an axis and a rotatable outer member having a continuous interior surface, the outer member disposed about and coaxial with the fixed core and rotatable about the axis to and from an at-rest position; and resilient structure completely disposed within the continuous interior surface and carried by the second lever for rotationally biasing the outer member back to the at-rest position after the outer member has been rotated from the at-rest position, whereby when the outer member is in the at-rest position, the resilient structure exerts substantially no biasing force on the outer member.

8. The shears of claim 7, wherein the interior surface of the rotatable outer member has a first substantially cylindrical interior surface portion having a radial shoulder structure and the fixed core has a first substantially cylindrical exterior surface portion facing the first substantially cylindrical interior surface portion of the rotatable outer member, and the resilient structure includes an elongated spring having a fixed end connected to the fixed core and a free end, whereby when the rotatable outer member is rotated out of the at-rest position the radial shoulder structure contacts and deflects the free end of the spring rotationally biasing the rotatable outer member back to the at-rest position.

9. The shears of claim 8, wherein the fixed core has a recess formed in the exterior surface portion defining a first stop surface and the outer member has a second stop surface projecting from the interior surface portion, whereby when the rotatable outer member is rotated a first predetermined distance the second stop surface contacts the first stop surface to prevent further rotation of the rotatable outer member.

10. The shears of claim 9, wherein the recess in the fixed core defines a third stop surface and the outer member has a fourth stop surface projecting from the interior surface portion wherein when the rotatable outer member is rotated clockwise the first predetermined distance the second stop surface contacts the first stop surface to limit clockwise rotation of the rotatable outer member and when the rotatable outer member is rotated counterclockwise a second predetermined distance the third stop surface contacts the fourth stop surface to limit counter-clockwise rotation of the outer member.

11. A two lever implement comprising: a first lever having a fixed first handle; a second lever pivotally connected to the first lever and having a second handle including a fixed core having an axis and an exterior surface and a rotatable outer member disposed about and coaxial with the fixed core and rotatable about the axis to and from an at-rest position, the outer member having an interior surface facing the exterior surface, the interior surface including a radial shoulder structure including first and second walls; and a resilient structure carried by the second lever for rotationally biasing the outer member back to the at-rest position after the outer member has been rotated from the at-rest position, whereby when the rotatable outer member is rotated out of the at-rest position in a first direction, the first wall of the radial shoulder structure contacts and deflects a portion of the resilient structure biasing the rotatable outer member back to the at-rest position, whereby when the rotatable outer member is rotated out of the at-rest position in a second direction, the second wall of the radial shoulder structure contacts and deflects a portion of the resilient structure biasing the rotatable outer member back to the at-rest position, whereby when the outer member is in the at-rest position, the resilient structure exerts substantially no biasing force on the outer member.

12. The implement of claim 11, wherein the resilient structure includes a spring.

13. The implement of claim 12, wherein the spring includes at least one end connected to the fixed core.

14. The implement of claim 12, wherein the spring includes an elongated portion whereby the radial shoulder structure contacts the elongated portion when the rotatable outer member is rotated out of the at-rest position.

15. The implement of claim 11, wherein the interior surface of the rotatable outer member is substantially cylindrical and the resilient structure is completely disposed within the interior surface of the rotatable outer member.

16. The implement of claim 11, wherein the first and second levers respectively include first and second blades.

* * * * *